US009598162B2

(12) United States Patent
Kinoshita

(10) Patent No.: US 9,598,162 B2
(45) Date of Patent: Mar. 21, 2017

(54) WATERCRAFT

(75) Inventor: Yoshimasa Kinoshita, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 556 days.

(21) Appl. No.: 13/594,902

(22) Filed: Aug. 27, 2012

(65) Prior Publication Data

US 2013/0252490 A1 Sep. 26, 2013

(30) Foreign Application Priority Data

Mar. 26, 2012 (JP) ..... 2012-069019

(51) Int. Cl.

| | |
|---|---|
| ***G06F 19/00*** | (2011.01) |
| ***B63H 21/00*** | (2006.01) |
| ***B63H 11/00*** | (2006.01) |
| *B63H 21/21* | (2006.01) |

(52) U.S. Cl.

CPC ..... *B63H 21/24* (2013.01); *B63H 11/00* (2013.01); *B63H 2021/216* (2013.01)

(58) Field of Classification Search

CPC .... F02D 11/105; F02D 2250/18; B60W 10/06

USPC ..... 701/101, 110, 114, 115; 123/319, 336, 123/337, 350, 351, 352, 360, 361

See application file for complete search history.

(56) References Cited

U.S. PATENT DOCUMENTS

| | | | | |
|---|---|---|---|---|
| 7,315,779 | B1 * | 1/2008 | Rioux et al. | 701/114 |
| 2005/0273224 | A1 * | 12/2005 | Ito et al. | 701/21 |
| 2010/0210155 | A1 * | 8/2010 | Kinoshita | 440/1 |

* cited by examiner

*Primary Examiner* — John Kwon

(74) *Attorney, Agent, or Firm* — Keating and Bennett, LLP

(57) ABSTRACT

In a watercraft, an engine rotational speed sensor detects a rotational speed of an engine. A determining section determines if a prescribed execution condition indicating that a hull body is moving is satisfied. A filter processing section applies a filter process to the engine rotational speed detected by the engine speed sensor to acquire a filtered engine rotational speed. A control section executes a maximum speed limiting control to limit a maximum speed of the watercraft when the prescribed execution condition is satisfied and the filtered engine rotational speed is larger than a prescribed rotational speed threshold value.

10 Claims, 5 Drawing Sheets

WATERCRAFT

BACKGROUND OF THE INVENTION

1. Field of the Invention

The present invention relates to a watercraft.

2. Description of the Related Art

Regarding watercrafts, there is a maximum speed limiting control that limits a maximum speed of the watercraft. For example, the watercraft disclosed in U.S. Pat. No. 7,315,779 includes an ECU and a watercraft speed sensor that detects a watercraft speed. The watercraft speed sensor detects an engine rotational speed. If the watercraft speed sensor detects that the watercraft speed is larger than a prescribed maximum watercraft speed, then the ECU controls a throttle valve actuator such that an opening degree of a throttle valve is decreased. In this way, the maximum speed is limited.

When a maximum speed limiting control is executed based on a detection value obtained with a watercraft speed sensor as explained above, the maximum speed limiting control is affected by the precision of the watercraft speed sensor. For example, U.S. Pat. No. 7,315,779 discloses using a pitot tube or a paddlewheel type sensor as the watercraft speed sensor. Since a pitot tube and a paddlewheel type sensor detect the watercraft speed using water flow, the accuracy with which the watercraft speed is detected can differ depending on the angle with which the water flow hits the pitot tube or the paddlewheel. In such a case, it is not easy to accurately determine whether to execute the maximum speed limiting control.

Therefore, it is possible to determine whether to execute the maximum speed limiting control based on the engine rotational speed instead of the watercraft speed. The engine rotational speed can be detected more accurately and easily than the watercraft speed. However, the engine rotational speed does not necessarily correspond to the watercraft speed and it is possible for a situation to occur in which the engine rotational speed is large but the watercraft is not even travelling on water. For example, even if the engine is operated with the watercraft on the ground, the maximum speed limiting control would be executed when the engine rotational speed exceeded a prescribed rotational speed threshold value.

SUMMARY OF THE INVENTION

In view of the problems described above, preferred embodiments of the present invention provide a watercraft that accurately determines whether to execute a maximum speed limiting control.

A watercraft according to a preferred embodiment of the present invention includes a hull body, a propulsion device, an engine, an engine rotational speed sensor, a determining section, a filter processing section, and a control section. The propulsion device propels the hull body. The engine drives the propulsion device. The engine rotational speed sensor detects a rotational speed of the engine. The determining section determines if a prescribed execution condition indicating that the hull body is moving is satisfied. The filter processing section applies a filter treatment to the engine rotational speed detected by the engine rotational speed sensor to acquire a filtered engine rotational speed. The control section executes a maximum speed limiting control that limits a maximum speed of the watercraft when the prescribed execution condition is satisfied and the filtered engine rotational speed is larger than a prescribed rotational speed threshold value.

With the watercraft according to a preferred embodiment of the present invention, the control section executes the maximum speed limiting control when both the prescribed execution condition and the condition that the filtered engine rotational speed is larger than a prescribed rotational speed threshold value are satisfied. Consequently, it is possible to avoid a situation in which the maximum speed limiting control is executed while the engine rotational speed is large but the watercraft is not cruising on water. As a result, the determination of whether to execute the maximum speed limiting control can be accomplished more accurately.

The reason that the engine rotational speed detected by the engine rotational speed sensor is not used as is and, instead, a filtered engine rotational speed is preferably used will now be explained. A change in the engine rotational speed does not necessarily correspond to an immediate change in watercraft speed. For example, if the watercraft starts rapidly into motion from a state in which the speed is 0, then the engine rotational speed will increase immediately but the watercraft speed will increase gradually and later than the engine rotational speed. Thus, if the engine rotational speed detected by the engine rotational speed sensor were used as is for the determination, then the maximum speed limiting control would be executed even though the watercraft speed has not increased sufficiently and the acceleration of the watercraft would be slow when rapidly starting the watercraft into motion. Therefore, by using a filtered engine rotational speed instead of using the detected engine rotational speed as is, the determination of whether to execute the maximum speed limiting control can be accomplished accurately.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
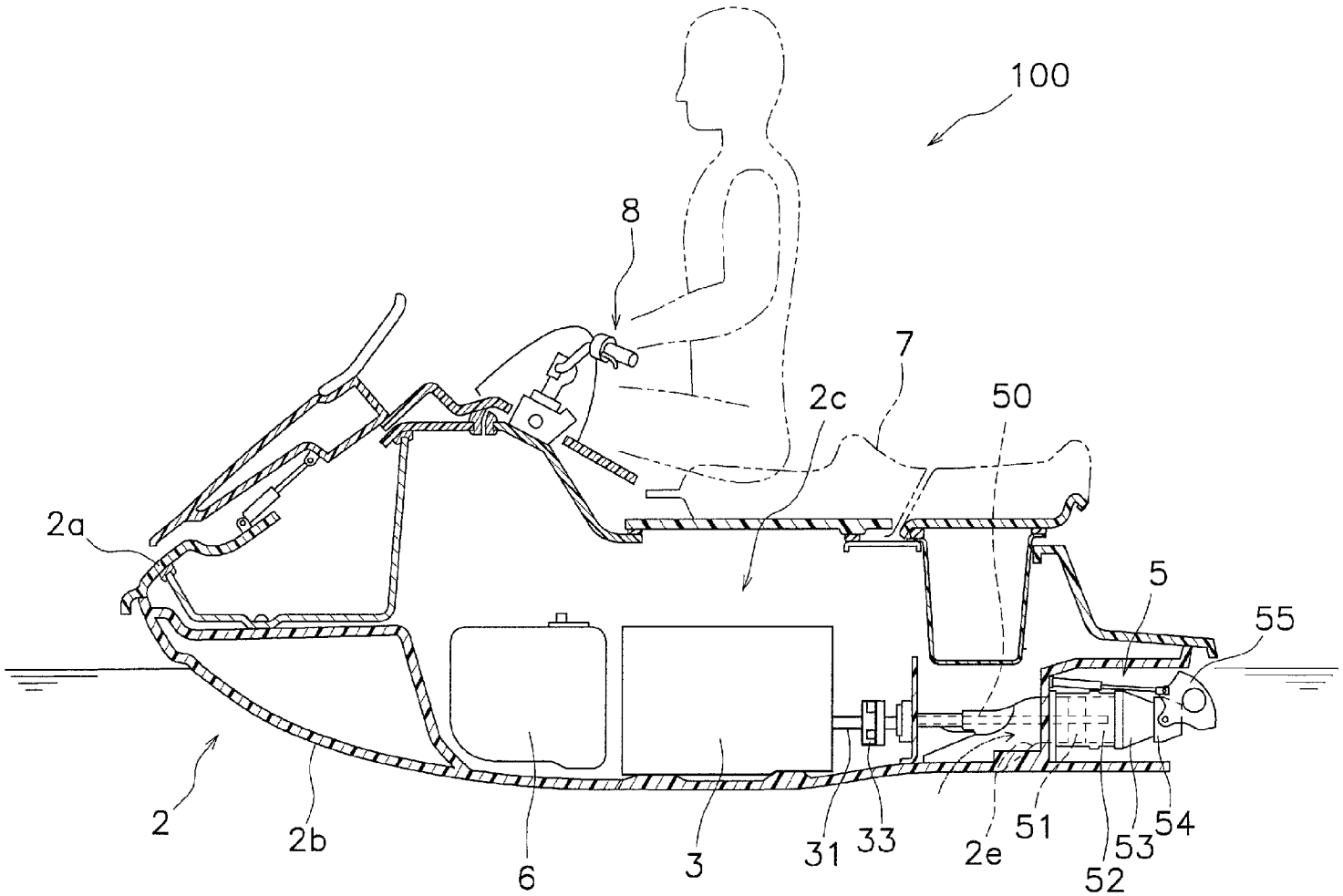
FIG. 1 is a sectional view schematically showing constituent features of a watercraft according to a preferred embodiment of the present invention.
Figure 2:
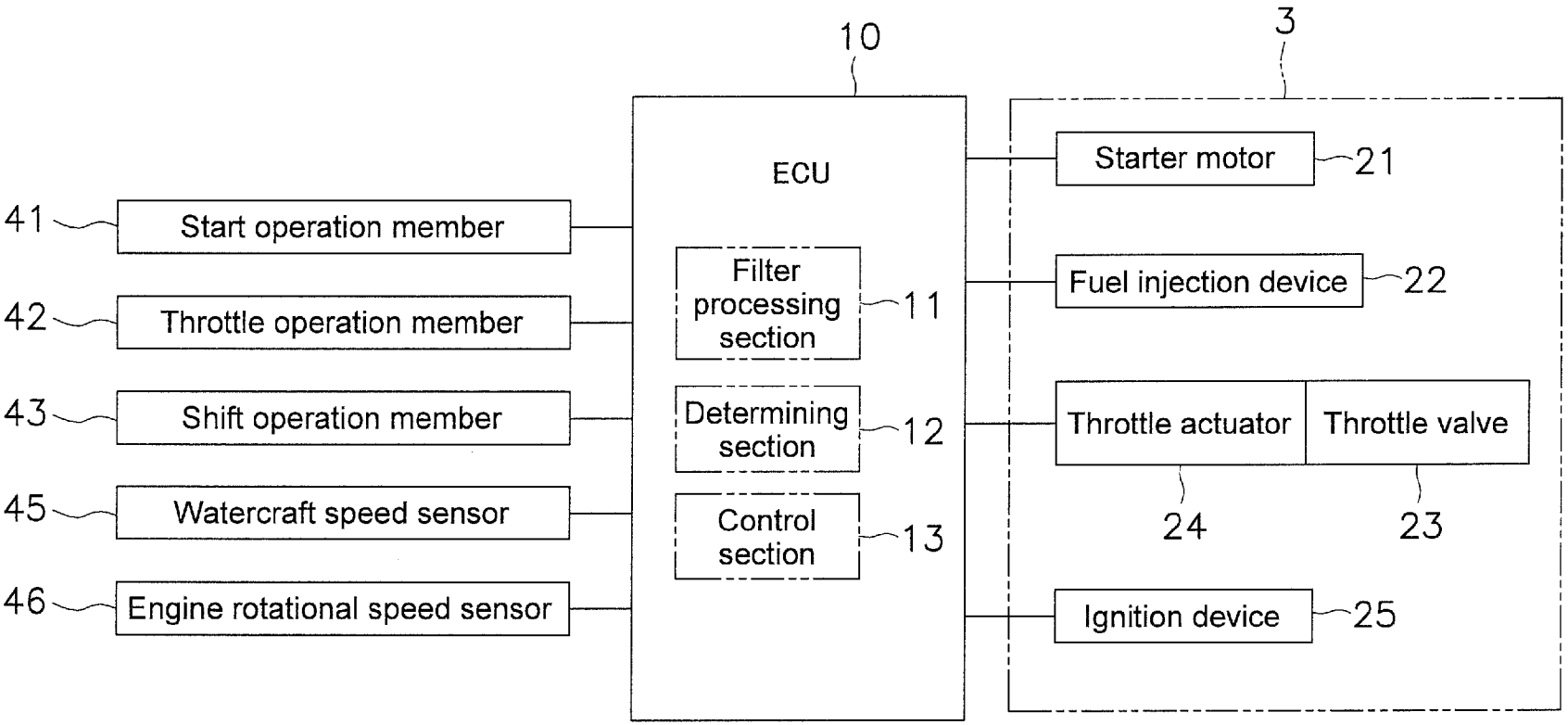
FIG. 2 is a block diagram showing a control system of the watercraft.

A watercraft according to preferred embodiments of the present invention will now be explained with reference to the drawings. FIG. 1 is a sectional view schematically showing constituent features of a watercraft 100 according to a preferred embodiment of the present invention. FIG. 2 is a block diagram showing a control system of the watercraft 100. The watercraft 100 is preferably a so-called personal watercraft (PWC), for example. As shown in FIG. 1, the watercraft 100 includes a hull body 2, an engine 3, and a propulsion device 5. The hull body 2 includes a deck 2*a* and a hull 2*b*. An engine room 2*c* is provided inside the hull body 2. The engine 3 and a fuel tank 6 are housed inside the engine room 2*c*. A seat 7 is attached to the deck 2*a*. The seat 7 is arranged above the engine 3. A steering handle 8 arranged to steer the hull body 2 is arranged in front of the seat 7.

The engine 3 is preferably, for example, an inline, four-cylinder, four-stroke engine. The engine 3 includes a crankshaft 31. The crankshaft 31 is arranged to extend in a longitudinal direction of the watercraft 100. As shown in FIG. 2, the engine 3 includes a starter motor 21, a fuel injection device 22, a throttle valve 23, a throttle actuator 24, and an ignition device 25. The starter motor 21 serves to start the engine 3. The fuel injection device 22 is arranged to inject fuel into a combustion chamber of the engine 3. An amount of air-fuel mixture delivered to the combustion chamber is adjusted by varying an opening degree of the throttle valve 23. In the present preferred embodiment, a common throttle valve 23 is preferably provided with respect to all of the cylinders of the engine 3. However, it is acceptable if a separate throttle valve 23 is provided with respect to each of the cylinders of the engine 3. The throttle actuator 24 changes the opening degree of the throttle valve 23. The ignition device 25 serves to ignite fuel inside the combustion chamber. Although not depicted in FIG. 2, the fuel injection device 22 and the ignition device 25 are provided on each cylinder of the engine 3.

The propulsion device 5 propels the hull body 2. The propulsion device 5 is preferably a so-called water jet propulsion device, for example. The jet propulsion device 5 is driven by the engine 3 and serves to draw in water from around the hull body 2 and shoot the water out. As shown in FIG. 1, the propulsion device 5 includes an impeller shaft 50, an impeller 51, an impeller housing 52, a nozzle 53, a deflector 54, and a reverse bucket 55. The impeller shaft 50 is arranged to extend rearward from the engine room 2*c*. A frontward portion of the impeller shaft 50 is coupled to the crankshaft 31 through a coupling section 33. A rearward portion of the impeller shaft 50 passes through a water suction section 2*e* of the hull body 2 and out through the inside of the impeller housing 52. The impeller housing 52 is connected to a rearward portion of the water suction section 2*e*. The nozzle 53 is arranged rearward of the impeller housing 52.

The impeller 51 is attached to a rearward portion of the impeller shaft 50. The impeller 51 is arranged inside the impeller housing 52. The impeller 51 rotates together with the impeller shaft 50 and draws in water from the water suction section 2*e*. The impeller 51 shoots the drawn water rearward from the nozzle 53. The deflector 54 is arranged rearward of the nozzle housing 53. The deflector 54 is arranged divert water ejected from the nozzle 53 such that the movement direction of the ejected water is changed in a leftward or a rightward direction. The reverse bucket 55 is arranged rearward of the deflector 54. The reverse bucket 55 is arranged to change the movement direction of water ejected from the nozzle 53 and diverted by the deflector 54 to a frontward direction.

As shown in FIG. 2, the watercraft 100 includes such operating members as a start operation member 41, a throttle operation member 42, and a shift operation member 43. The operating members are arranged to be operated by an operator. The start operation member 41 is used to start the engine 3. The start operation member 41 is, for example, a start switch. The throttle operation member 42 is used to increase or decrease a rotational speed of the engine 3. The throttle operation member 42 increases and decreases the engine speed by varying an opening degree of the throttle valve 23. The throttle operation member 42 is, for example, a throttle lever. The shift operation member 43 serves to change between forward propulsion and reverse propulsion of the watercraft 100. The shift operation member 43 changes between forward propulsion and reverse propulsion of the watercraft 100 by varying a position of the reverse bucket 55. The shift operation member 43 is, for example, a shift lever.

As shown in FIG. 2, the watercraft 100 includes an ECU (electronic control unit) 10. The ECU 10 controls the engine 3. That is, the ECU 10 sends command signals to the starter motor 21, the fuel injection device 22, the throttle actuator 24, and the ignition device 25 and electrically controls these devices. When the start operation member 41 is operated, the ECU 10 drives the starter motor 21 and the engine 3 starts. The ECU 10 controls the fuel injection device 22 to control the amount of fuel supplied to the combustion chamber of the engine 3. The ECU 10 controls the opening degree of the throttle valve 23 by driving the throttle actuator 24.

The watercraft 100 includes a watercraft speed sensor 45 and an engine rotational speed sensor 46, as shown in FIG. 2, as well as other sensors not shown in the figures. The watercraft speed sensor 45 detects a speed of the watercraft 100. The watercraft speed sensor 45 preferably detects the speed based on a water flow. More specifically, the watercraft speed sensor 45 is preferably a paddlewheel type sensor, for example. The watercraft speed sensor 45 outputs a detection signal when the watercraft speed is larger than 0. That is, it does not output a detection signal when the watercraft speed is 0. The engine rotational speed sensor 46 detects a rotational speed of the engine. The other sensors include, for example, sensors serving to detect an external air temperature, a water temperature, and an oil temperature. The ECU 10 receives the detection signals from these sensors. The ECU 10 is programmed to control the engine 3 based on information detected by these sensors.

Figure 3:
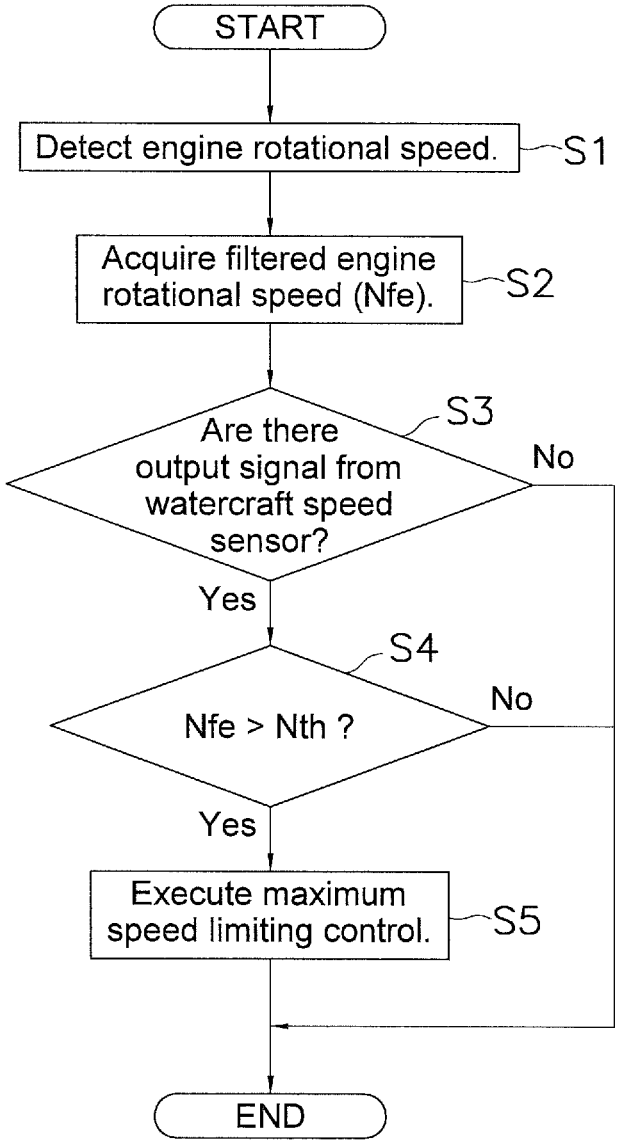
FIG. 3 is a flowchart showing steps of the maximum speed limiting control.

The ECU 10 is programmed to execute a maximum speed limiting control to limit a maximum speed of the watercraft 100. The maximum speed limiting control will now be explained. As shown in FIG. 2, the ECU 10 includes a filter processing section 11, a determining section 12, and a control section 13. FIG. 3 is a flowchart showing steps of the maximum speed limiting control.

In step S1, the engine rotational speed sensor 46 detects the engine rotational speed. In step S2, the filter processing section 11 acquires the engine rotational speed. The filter processing section 11 is programmed to apply filter processing to the engine rotational speed detected by the engine rotational speed sensor 46 to acquire a filtered engine rotational speed (Nfe). The filter processing converts the engine rotational speed detected by the engine rotational speed sensor 46 to a value having a smaller deviation with respect to the watercraft speed. For example, the filter processing is preferably a moving average filter. A moving average filter is a publically known technology, e.g., the technology disclosed in Japanese Laid-open Patent Application Publication No. 2004-100689, herein incorporated in its entirety by reference.

In step S3, the determining section 12 is programmed to determine if there is an output signal from the watercraft speed sensor 45. If it detects an output signal from the watercraft sensor 45, then the ECU 10 proceeds to step S4. That is, if the watercraft speed is larger than 0, the ECU 10 proceeds to step S4.

In step S4, the determining section 12 is programmed to determine if the filtered engine rotational speed (Nfe) is larger than a prescribed rotational speed threshold value (Nth). For example, the rotational speed threshold value (Nth) is an engine rotational speed value corresponding to a maximum speed limit value. If the filtered engine rotational speed (Nfe) is larger than the prescribed rotational speed threshold value (Nth), then the ECU 10 proceeds to step S5.

In step S5 the control section 13 executes the maximum speed limiting control. In the maximum speed limiting control, the control section 13 is programmed to execute processing that reduces the engine rotational speed. More specifically, during the maximum speed limiting control, the control section 13 controls the throttle actuator 24 so as to decrease the opening degree of the throttle valve 23, for example.

If an output signal from the watercraft speed sensor 45 is not detected in step S3, then the control section 13 does not execute the maximum speed limiting control. If the filtered engine rotational speed (Nfe) is determined to be equal to or smaller than the prescribed rotational speed threshold value (Nth) in step S4, then the control section 13 does not execute the maximum speed limiting control. Thus, the control section 13 limits the maximum speed of the watercraft 100 only when the watercraft speed is larger than 0 and the filtered engine rotational speed (Nfe) is larger than the prescribed rotational speed threshold value (Nth).

With the watercraft 100 according to the present preferred embodiment, the control section 13 executes the maximum speed limiting control when both the condition that the watercraft speed is larger than 0 and the condition that the filtered engine rotational speed is larger than the prescribed rotational speed threshold value are satisfied. Consequently, it is possible to avoid a situation in which the maximum speed limiting control is executed while the engine rotational speed is large but the watercraft 100 is not cruising on water. In this way, an accurate determination of whether to execute the maximum speed limiting control can be accomplished.

By using the filtered engine rotational speed to determine when to execute the maximum speed limiting control, an accurate determination of whether to execute the maximum speed limiting control can be accomplished even if the watercraft speed cannot be detected accurately. As a result, an accurate determination of whether to execute the maximum speed limiting control can be accomplished even if a paddlewheel type sensor or other inexpensive sensor is used as the watercraft speed sensor 45.

Instead of using the engine rotational speed detected by the engine rotational speed sensor 46 as is, the filtered engine rotational speed is used to execute the maximum rotational speed limiting control. The filtered engine rotational speed is a value obtained by filtering the engine rotational speed such that it has a smaller deviation with respect to the watercraft speed. Thus, an accurate determination of whether to execute the maximum speed limiting control can be accomplished.

Although preferred embodiments of the present invention have been explained herein, the present invention is not limited to the preferred embodiments described above. Various changes can be made without departing from the scope of the present invention.

Although in the previously explained preferred embodiment, a PWC is presented as an example of the watercraft, preferred embodiments of the present invention can also be applied to jet boats and other types of watercraft. In addition to watercrafts, preferred embodiments of the present invention can also be applied to snowmobiles and other vehicles.

Figure 4:
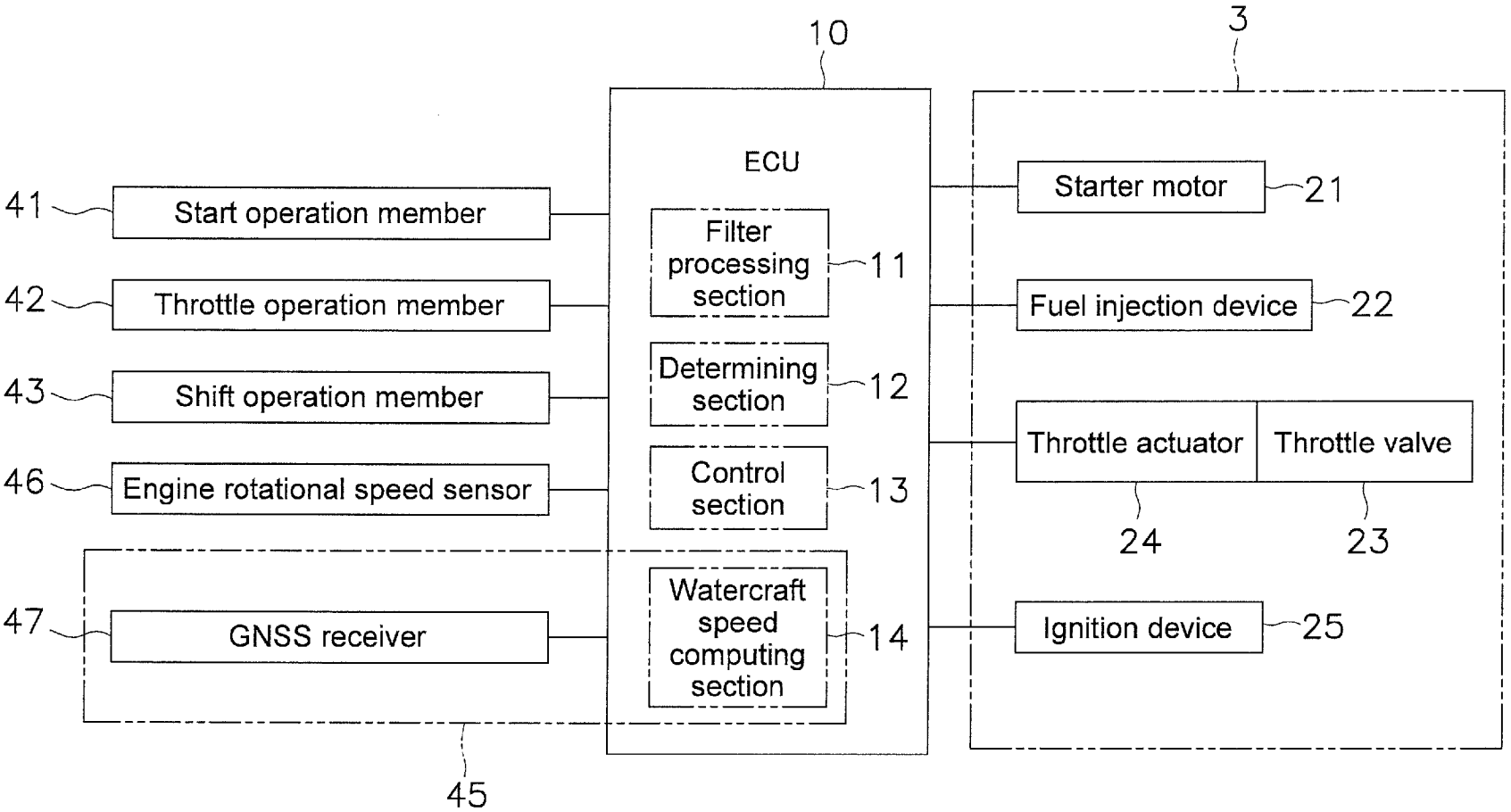
FIG. 4 is a block diagram showing a control system of a watercraft according to another preferred embodiment of the present invention.

Although in the previously explained preferred embodiment a paddlewheel sensor is presented as an example of the watercraft speed sensor 45, it is acceptable to use a pitot tube sensor. It is also acceptable to use another detection method instead of a sensor that detects the watercraft speed based on a flow of water as in the case of a paddlewheel or a pitot tube. For example, as shown in FIG. 4, it is acceptable for the watercraft 100 to be equipped with a GNSS (Global Navigation Satellite System) receiver 47 that detects position information of the watercraft 100. In such a case, the ECU 10 includes a watercraft speed computing section 14. The watercraft speed computing section 14 is programmed to compute the watercraft speed based on the position information of the watercraft 100 detected by the GNSS receiver 47. Thus, the watercraft sensor 45 includes the GNSS receiver 47 and the watercraft speed computing section 14.

Figure 5:
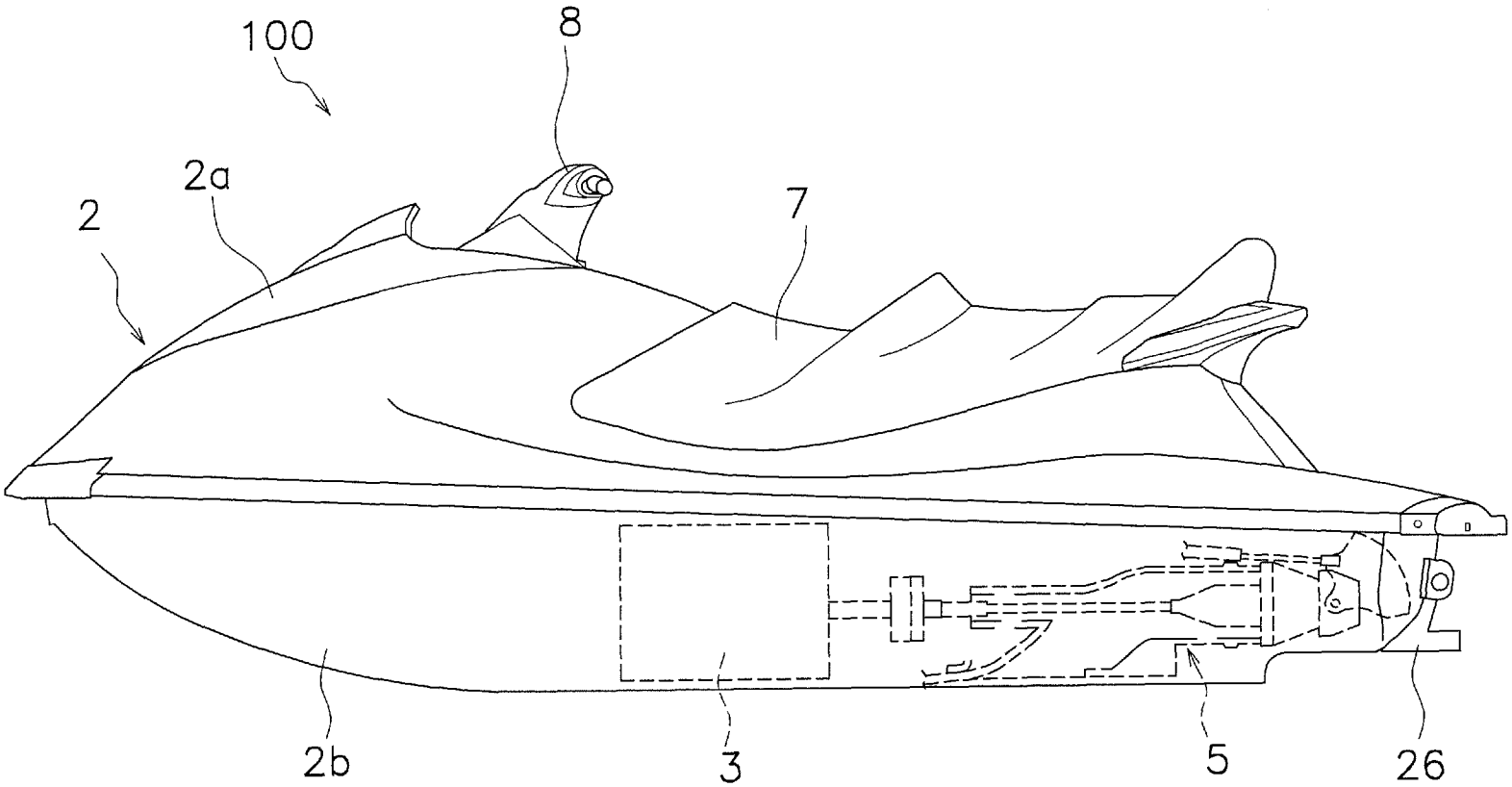
FIG. 5 is a side view of a watercraft according to another preferred embodiment of the present invention.

Although in the previously explained preferred embodiment the maximum speed is limited preferably by executing a control to decrease the opening degree of the throttle valve 23, it is acceptable to limit the maximum speed using another method. For example, as shown in FIG. 5, it is acceptable for the watercraft 100 to be equipped with a resistance device 26. The resistance device 26 is, for example, a trim tab. The resistance device 26 is provided such that it can move between a storage position and an operating position. The resistance device 26 is controlled by the ECU 10 to be set to either the storage position or the operating position. When in the operating position, the resistance device 26 bears a resistance exerted by the water during cruising. When the resistance device 26 is in the storage position, the water resistance on the resistance device 26 during cruising is minimized. During the maximum speed limiting control, the control section 13 is programmed to move the resistance device 26 from the storage position to the operating position. As a result, the maximum speed is limited.

It is acceptable for the prescribed execution condition indicating that the watercraft 100 is moving to be the condition that the watercraft speed detected by the watercraft speed sensor 45 is larger than a prescribed watercraft speed threshold value. Although in the previously explained preferred embodiment the watercraft speed threshold value is 0, it is acceptable for the watercraft speed threshold value to be any value that can indicate whether the watercraft is moving. Thus, in consideration of external disturbances, it is acceptable for the watercraft threshold value to be a value larger than 0. For example, it is acceptable to set the watercraft speed threshold value to a value larger than 0 and smaller than or equal to about 30 km/h, for example. It is also acceptable to set the watercraft speed threshold value to a value larger than 0 and smaller than or equal to about 10 km/h, for example. It is also acceptable to set the watercraft speed threshold value to a value larger than 0 and smaller than or equal to about 5 km/h, for example. It is also acceptable to set the watercraft speed threshold value to a value larger than 0 and smaller than or equal to about 50%, for example, of a maximum speed limit value.

It is also acceptable to make the prescribed execution condition that the watercraft speed detected by the watercraft speed sensor 45 has exceeded a prescribed watercraft speed threshold value at least once during a period from when the engine was started until a current time. For example, it is acceptable for the prescribed execution condition to be that an output signal from the watercraft speed sensor 45 has been detected at least n times (where n is a positive number larger than 1) during a period from when the engine was started until the current time.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft comprising:

a hull body;

a propulsion device arranged to propel the hull body;

an engine arranged to drive the propulsion device;

an engine rotational speed sensor arranged to detect an engine rotational speed;

a determining section programmed to determine if a prescribed execution condition indicating that the hull body is moving is satisfied;

a filter processing section programmed to apply a moving average filter processing to the engine rotational speed detected by the engine rotational speed sensor to acquire a filtered engine rotational speed; and a control section programmed to execute a maximum speed limiting control to limit a maximum speed of the watercraft when the determining section determines that the hull body is moving and the filtered engine rotational speed is larger than a prescribed rotational speed threshold value; wherein the control section is further programmed to not execute the maximum speed limiting control when the prescribed execution condition is not satisfied even when the filtered engine rotational speed is larger than the prescribed rotational speed threshold value.

2. The watercraft according to claim 1, wherein the watercraft further comprises a watercraft speed sensor arranged to detect the watercraft speed of the watercraft; and the prescribed execution condition includes a condition that the watercraft speed detected by the watercraft speed sensor is larger than a prescribed watercraft speed threshold value.

3. The watercraft according to claim 2, wherein the watercraft speed threshold value is 0.

4. The watercraft according to claim 2, wherein the prescribed execution condition includes a condition that the watercraft speed detected by the watercraft speed sensor has exceeded the prescribed watercraft speed threshold value at least once during a period of time from when the engine was started until a current time.

5. The watercraft according to claim 2, wherein the watercraft speed sensor is arranged to detect the watercraft speed based on a water flow.

6. The watercraft according to claim 5, wherein the watercraft speed sensor is a paddlewheel type sensor.

7. The watercraft according to claim 2, wherein the watercraft speed sensor includes a Global Navigation Satellite System receiver that detects position information of the watercraft; and the watercraft speed sensor arranged to detect a watercraft speed based on the position information of the watercraft detected by the Global Navigation Satellite System receiver.

8. The watercraft according to claim 1, wherein the control section is programmed to decrease the engine rotational speed as the maximum speed limiting control.

9. The watercraft according to claim 1, wherein the engine includes a throttle valve and a throttle actuator that changes an opening degree of the throttle valve; and the control section is programmed to decrease the opening degree of the throttle valve by controlling the throttle actuator as the maximum speed limiting control.

10. The watercraft according to claim 1, wherein the watercraft further comprises a resistance device arranged to be moved between a storage position and an operating position and, when in the operating position, the resistance device bears a resistance exerted by water during cruising on water; and the control device is programmed to move the resistance device from the storage position to the operating position as the maximum speed limiting control.

* * * * *